US006951192B2

(12) United States Patent
Atschreiter et al.

(10) Patent No.: US 6,951,192 B2
(45) Date of Patent: Oct. 4, 2005

(54) METHOD AND APPARATUS FOR REGULATING THE OPERATING TEMPERATURE OF AN INTERNAL COMBUSTION ENGINE

(75) Inventors: Friedrich Atschreiter, Allhartsberg (AT); Wolfgang Bass, Bretzfeld-Adolzfurt (DE); Martin Kurz, Wüstenrot (DE)

(73) Assignees: Robert Seuffer GmbH & CO KG (DE); TOG Unitech AG (AT)

( * ) Notice: Subject to any disclaimer, the term of this patent is extended or adjusted under 35 U.S.C. 154(b) by 13 days.

(21) Appl. No.: 10/615,650

(22) Filed: Jul. 8, 2003

(65) Prior Publication Data

US 2004/0031451 A1 Feb. 19, 2004

(30) Foreign Application Priority Data

Jul. 9, 2002 (DE) ..... 102 30 941

(51) Int. Cl.[7] ..... F01P 9/00
(52) U.S. Cl. ..... 123/41.01; 123/41.44
(58) Field of Search ..... 123/41.44, 41.12, 123/41.46, 41.47, 198 C, 41.01

(56) References Cited

U.S. PATENT DOCUMENTS 5,785,013 A * 7/1998 Sinn et al. ..... 123/41.44
6,199,528 B1 * 3/2001 Hotta et al. ..... 123/142.5 E
6,425,353 B1 * 7/2002 Davies ..... 123/41.44
6,612,815 B2 * 9/2003 Pawellek et al. ..... 417/366

FOREIGN PATENT DOCUMENTS

DE 10058374 A1 * 6/2002 ..... F01P/7/14

* cited by examiner

*Primary Examiner*—Henry C. Yuen
*Assistant Examiner*—Hyder Ali
(74) *Attorney, Agent, or Firm*—Ostrolenk, Faber, Gerb & Soffen, LLP

(57) ABSTRACT

A method and an apparatus for regulating the operating temperature of an internal combustion engine, wherein a cooling fluid is transported in a circuit through the internal combustion engine by means of a cooling fluid pump driven by an electric motor. The electric motor can be operated with a power dissipation loss which is increased in comparison with its nominal operation and the waste heat produced in that situation is transmitted to the cooling fluid.

11 Claims, 4 Drawing Sheets

METHOD AND APPARATUS FOR REGULATING THE OPERATING TEMPERATURE OF AN INTERNAL COMBUSTION ENGINE

FIELD OF THE INVENTION

The invention concerns a method and an apparatus for regulating the operating temperature of an internal combustion engine.

BACKGROUND OF THE INVENTION

Fluid-cooled internal combustion engines are cooled by a cooling fluid being circulated through the internal combustion engine and then usually also through a suitable radiator in heat-exchange relationship with the atmospheric air, with the cooling fluid being driven through the cooling fluid circuit by a pump. In this respect reference may be made to DE 100 58 374 A1 which provides that the cooling fluid is circulated through the engine by means of a pump driven by an electric motor, with the electric motor being controlled in dependence on the prevailing temperature of the cooling fluid. In that case semiconductor devices which serve to regulate operation of the electric pump motor and/or a radiator fan motor also perform the function of affording additional heating, with the semiconductor devices being operated in a lossy fashion when the internal combustion engine is in a cold-start condition, with the waste heat resulting therefrom being transferred to the cooling fluid. Particularly in the cold-start phase of the internal combustion engine, the cooling water can be quickly heated up without the need for an additional heating unit, as is known from EP 0 993 546 A1, with the consequence that the internal combustion engine is raised to its normal operating temperature of the order of magnitude of between 80° C. and 90° C. within a reduced period of time.

SUMMARY OF THE INVENTION

An object of the present invention is to provide a method of regulating the operating temperature of a fluid-cooled internal combustion engine, which affords an enhanced option for rapidly heating the cooling fluid, as in the cold-start phase of the engine.

Another object of the present invention is to accelerate heating of the cooling fluid of an internal combustion engine to the normal engine operating temperature by adopting a specifically controlled mode of operation of the cooling fluid circuit.

Still another object of the present invention is to provide an apparatus for regulating the operating temperature of an internal combustion engine by affording an additional heating effect to raise the engine temperature to or maintain it at its normal operating temperature.

In accordance with the principles of the present invention in the method aspect the foregoing and other objects are attained by a method of regulating the operating temperature of an internal combustion engine, in which a cooling fluid is circulated through the engine by means of a pump driven by an electric motor. The temperature of the cooling fluid is measured and the electric pump motor is controlled in dependence on the measured temperature. At a fluid temperature below the normal engine operating temperature, waste heat produced by the electric pump motor is transferred to the cooling fluid.

In accordance with the invention in the apparatus aspect the foregoing and other objects are attained by an apparatus for regulating the operating temperature of an internal combustion engine, comprising a cooling fluid circuit for circulating cooling fluid through the internal combustion engine, with a cooling fluid pump being provided to transport the cooling fluid in the circuit. The cooling fluid pump is driven by an electric motor, with at least part of the electric motor which produces waste heat being arranged in heat-exchange relationship with the cooling fluid circuit. A control device controls operation of the electric motor in dependence on the temperature of the cooling fluid.

As will be seen in greater detail from preferred embodiments described hereinafter, the invention provides that the cooling fluid is additionally heated by the waste heat produced by the electric motor, in the cold-start phase of the engine or when the engine is being operated at a temperature below its normal operating temperature.

In accordance with a preferred feature of the invention, in that case, the electric motor pump is operated with a power dissipation loss which is increased in comparison with its normal mode of operation. For that purpose the electric motor, during the phase of heating up the cooling fluid, can be operated temporarily at or above its saturation limit. That results in an increased current flow, with the power dissipation loss rising quadratically with the current. Preferably the electric motor is supplied with a pulsed current. Operation can be controlled, at or above the saturation limit, by a suitable switching frequency in respect of the current pulses.

In addition, in another preferred feature of the invention, the supply current can be passed through the motor windings alternately in opposite directions. By virtue of a rotating field which is controlled by forward and reverse current in that way and a current flow between the forward and reverse rotation of the rotating field or by virtue of an alternating current in the windings, with only a low level of mechanical power delivery for transporting the cooling fluid, that also provides a high level of waste heat delivery from the electric motor or the motor windings thereof.

The motor and the cooling fluid pump driven thereby are arranged in such a way that the waste heat can be substantially directly delivered to the cooling fluid. For that purpose, the motor can be provided in its housing and in particular in the region of the motor windings of the stator, with ducts through which the cooling fluid is passed. With the low level of mechanical power delivery from the electric motor to the pump, the cooling fluid is moved slowly past the parts of the electric motor which give off the heat, for heat to be effectively transferred from the electric motor to the cooling fluid. Preferably, the stator and the rotor of the electric motor as well as the pump impeller can be arranged in a housing, with the cooling fluid preferably being taken past the motor windings of the stator for effective heat exchange from the pump to the cooling fluid.

Further objects, features and advantages of the invention will be apparent from the description hereinafter of preferred embodiments of the invention.

DESCRIPTION OF THE PREFERRED EMBODIMENTS

Figure 1:
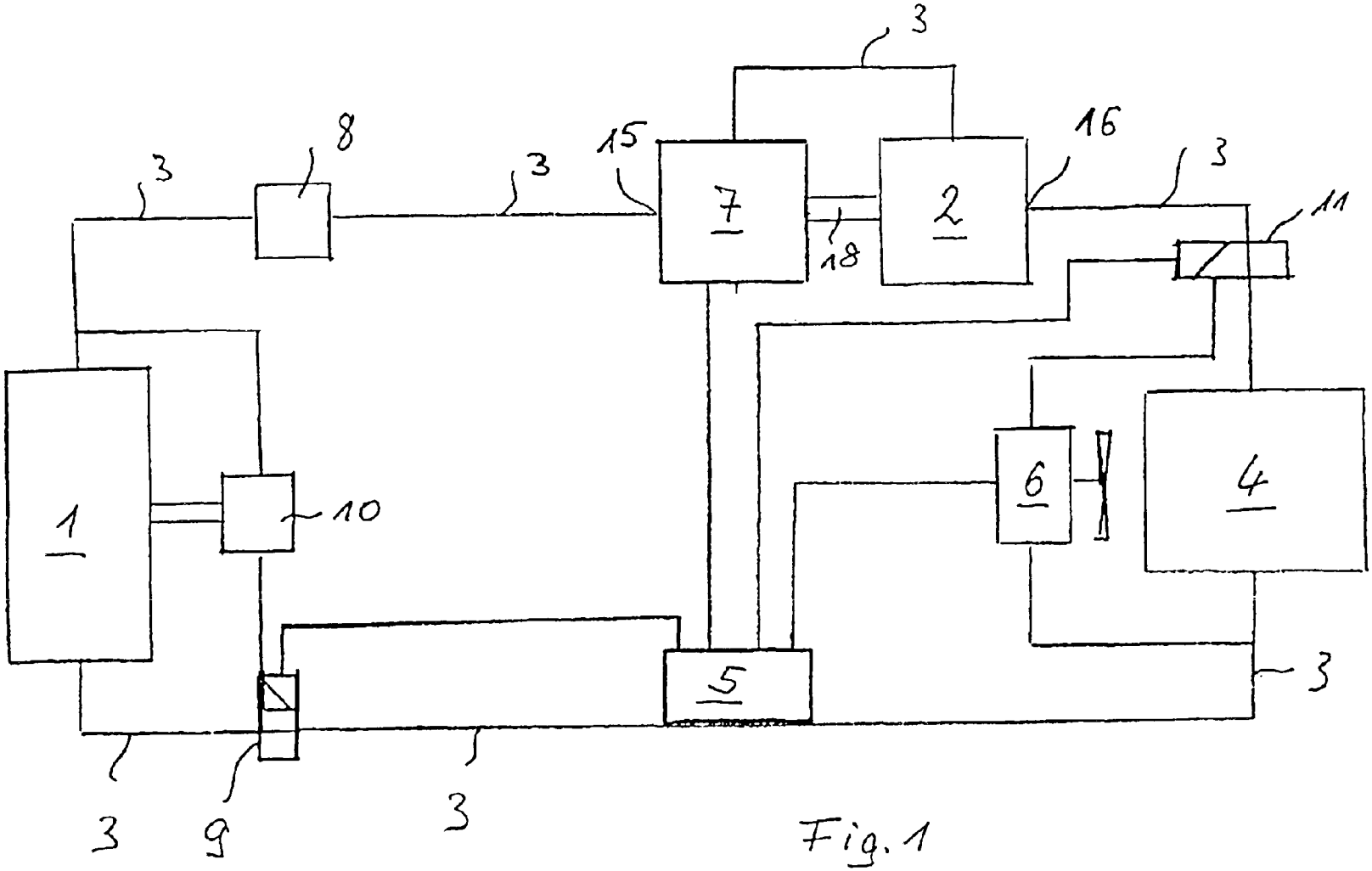
FIG. 1 shows a cooling fluid circuit of an internal combustion engine.

Reference will first be made to FIG. 1 diagrammatically showing the cooling fluid circuit of a water-cooled internal combustion engine generally indicated at 1. The internal combustion engine 1 can be for example an Otto-cycle engine or a diesel engine of a motor vehicle. The cooling fluid is transported through the cooling fluid circuit in the form of a conduit system 3 in the usual manner by means of a pump 2. The pump 2 is driven by means of an electric pump motor 7.

The cooling fluid coming from the internal combustion engine 1 is cooled in normal operation of the engine in an air/heat exchanger 4, in the form of a radiator. Disposed in the region of the heat exchanger 4 is a fan 10 driven by a fan motor 6. Reference numeral 5 denotes a control device which serves to control operation of the electric pump motor 7 and also operation of the fan motor 6.

Figure 2:
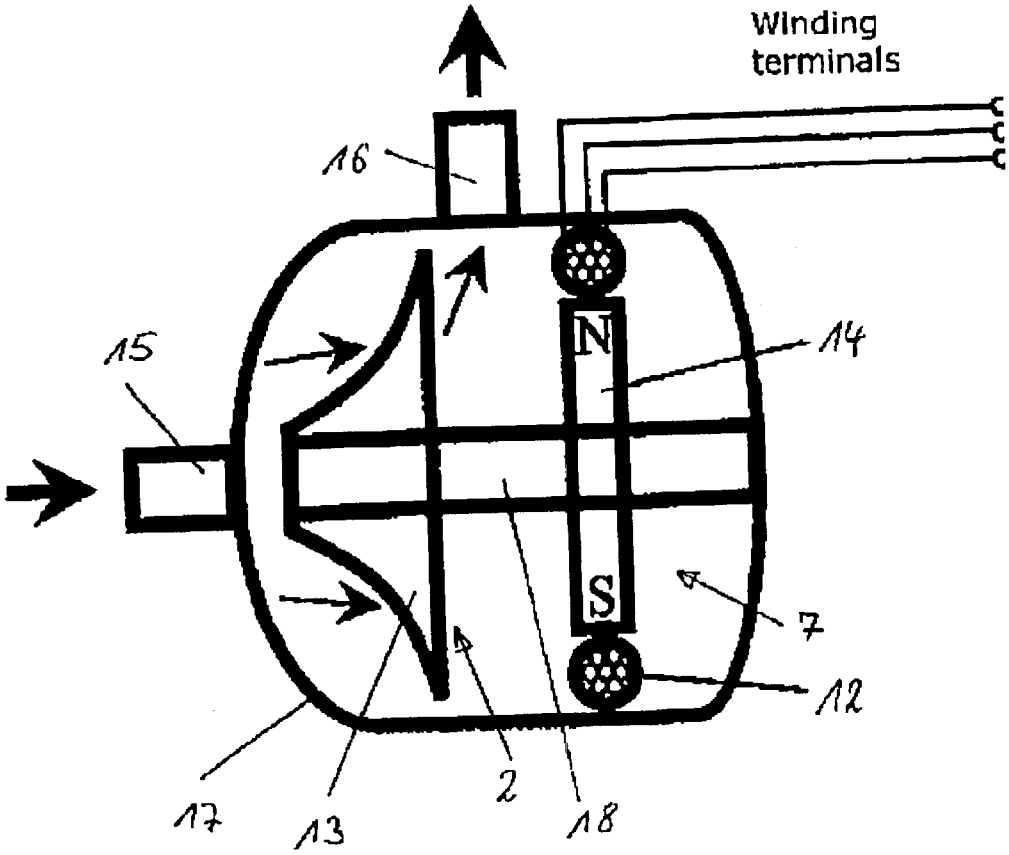
FIG. 2 shows an embodiment of a unit including an electric drive and a cooling fluid pump.

Parts of the electric pump motor 7 and preferably motor windings 12 of the motor stator, as can be seen from FIG. 2, which in corresponding operation produce increased waste heat, are disposed in one or more conduits through which the cooling fluid passes. For that purpose, the cooling fluid conduits are passed in the immediate proximity of the motor windings 12 through for example suitable grooves between the stator windings or in the motor housing. That is diagrammatically illustrated in FIG. 1 by virtue of the fact that the electric motor 7 is illustrated as being actually arranged in the coolant conduit 3.

In the structure shown in FIG. 2 the electric motor 7 and the cooling fluid pump 2 are disposed in the form of a unit in a housing 17. FIG. 2 shows essential component parts of the electric motor 7 constituting the electric drive for the pump 2, in the form of a rotor 14 which preferably has a permanent magnet, for example preferably a multipole-magnetised permanent magnet, as well as the motor windings 12 which produce a rotating field. The rotor 14 is non-rotatably connected to a pump impeller 13 by means of a shaft 18 which is supported at or in the housing 17 in any suitable fashion. The cooling fluid is passed into the illustrated unit consisting of the electric motor and the pump by way of a feed 15 and leaves the unit again at a discharge 16. In the illustrated structure the motor windings 12 in the housing 17 have the transported cooling fluid flowing therearound so that the waste heat produced in the motor windings 12 in operation of the pump is delivered to the cooling fluid. In this embodiment the cooling fluid is passed through the unit consisting of the electric motor and the pump even during normal operation at the desired temperature.

In an alternative arrangement in which the pump 2 and the electric motor 7 driving same are disposed separately, in normal operation the cooling fluid can be caused to pass through a suitable by-pass conduit around the electric motor by suitably setting a valve.

Looking once again at FIG. 1 the arrangement further includes a temperature measuring device 8, for example a thermostat. The temperature measuring device 8 is operable to measure the temperature of the internal combustion engine 1 or the temperature of the cooling fluid as it leaves the internal combustion engine 1. The two electric motors 6 and 7 are controlled in dependence on that temperature measurement.

As is disclosed in DE 100 98 374 A1 semiconductor devices forming part of the control unit 5, in particular power semiconductor devices, can also be used for additionally heating the cooling fluid in the conduit 3 of the cooling fluid circuit.

It will be noted at this point that the present invention involves the use of a cooling fluid pump 2 which is driven by the electric motor 7 and with which the cooling fluid is appropriately transported through the conduit system 3 of the cooling fluid circuit. The electric motor 7 is preferably an electric motor which is electronically switched by the control device 5 and in which a rotating field is produced by means of a motor current cyclically controlled by semiconductor switches of the control device 5. In the normal mode of operation actuation is such that the semiconductor switches of the control device 5 are switched at the switching time with the optimum rotary field and thus with the optimum degree of motor efficiency, as can be clearly seen from FIG. 3. It will be noted in this respect that the motor windings 12 are arranged directly in or at the cooling fluid, preferably in the manner illustrated in FIG. 2.

To provide the effect of heating the cooling fluid, the electric motor 7 can preferably be controlled in such a way that both the control device 5 and in particular the semiconductor devices thereof, and also the electric motor 7, have a poor level of operational efficiency in comparison with normal operation. That will afford an increased level of waste heat which serves as heating power for heating up the cooling fluid in the cold-start phase of the internal combustion engine or when the engine is operating at a temperature below its normal operating temperature.

Figure 3:
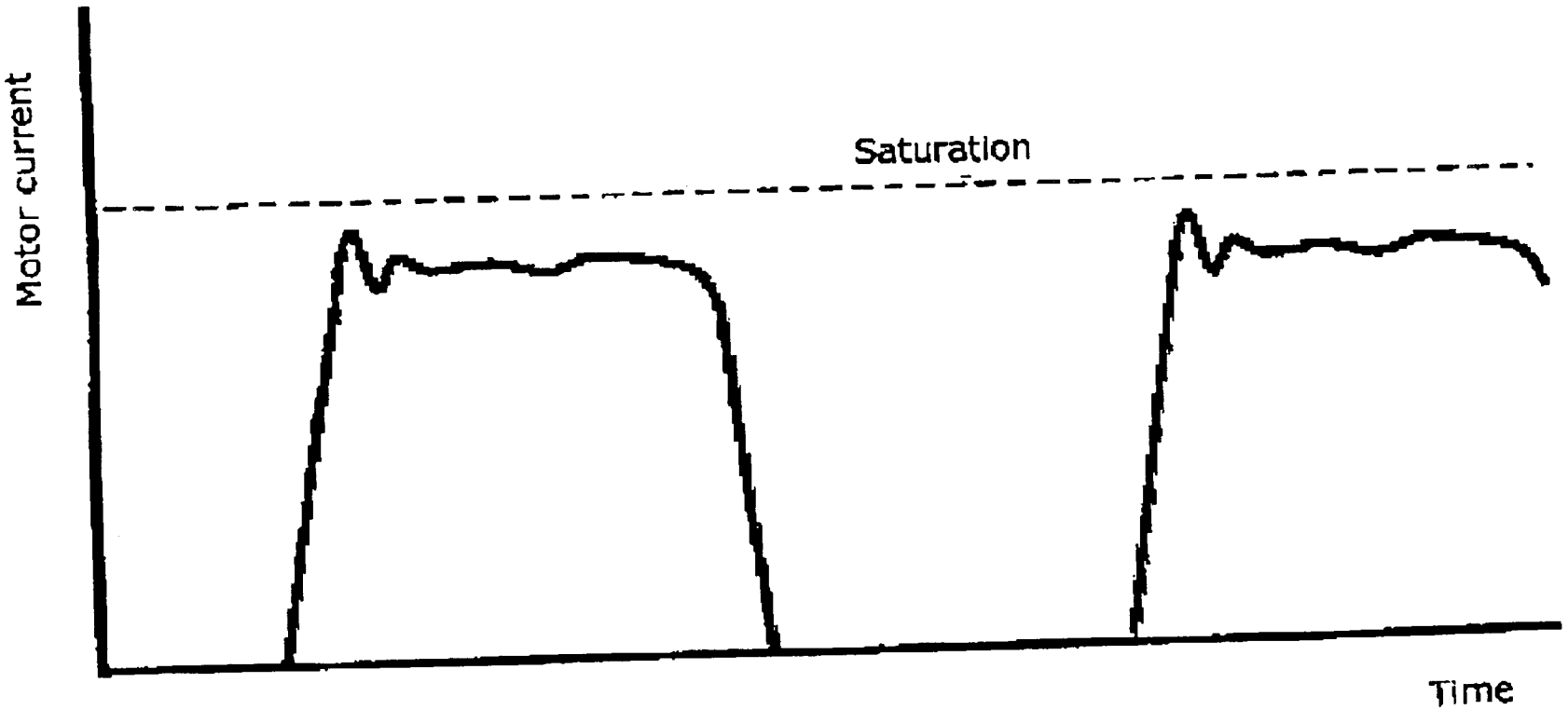
FIG. 3 shows current pulses for powering the electric motor of the cooling fluid pump at nominal operation.

It will be appreciated in this respect that it is also possible, in order to heat up the cooling fluid to the normal engine operating temperature, for the motor 7 to be operated in its nominal mode of operation, for example with a pulsed motor current, as is shown in FIG. 3, in which case the waste heat which is produced in that situation is appropriately transmitted to the cooling fluid.

A poor level of efficiency of the electronic components and in particular the semiconductor power components of the control device 5, as referred to hereinbefore, is afforded by the semiconductor switches being operated with a low gate control current and with slowly rising edges. The power dissipation loss during the switching edges is very high as voltage and current are present at the same time at the semiconductor switch. In that situation interference radiation phenomena advantageously fall.

Figure 4:
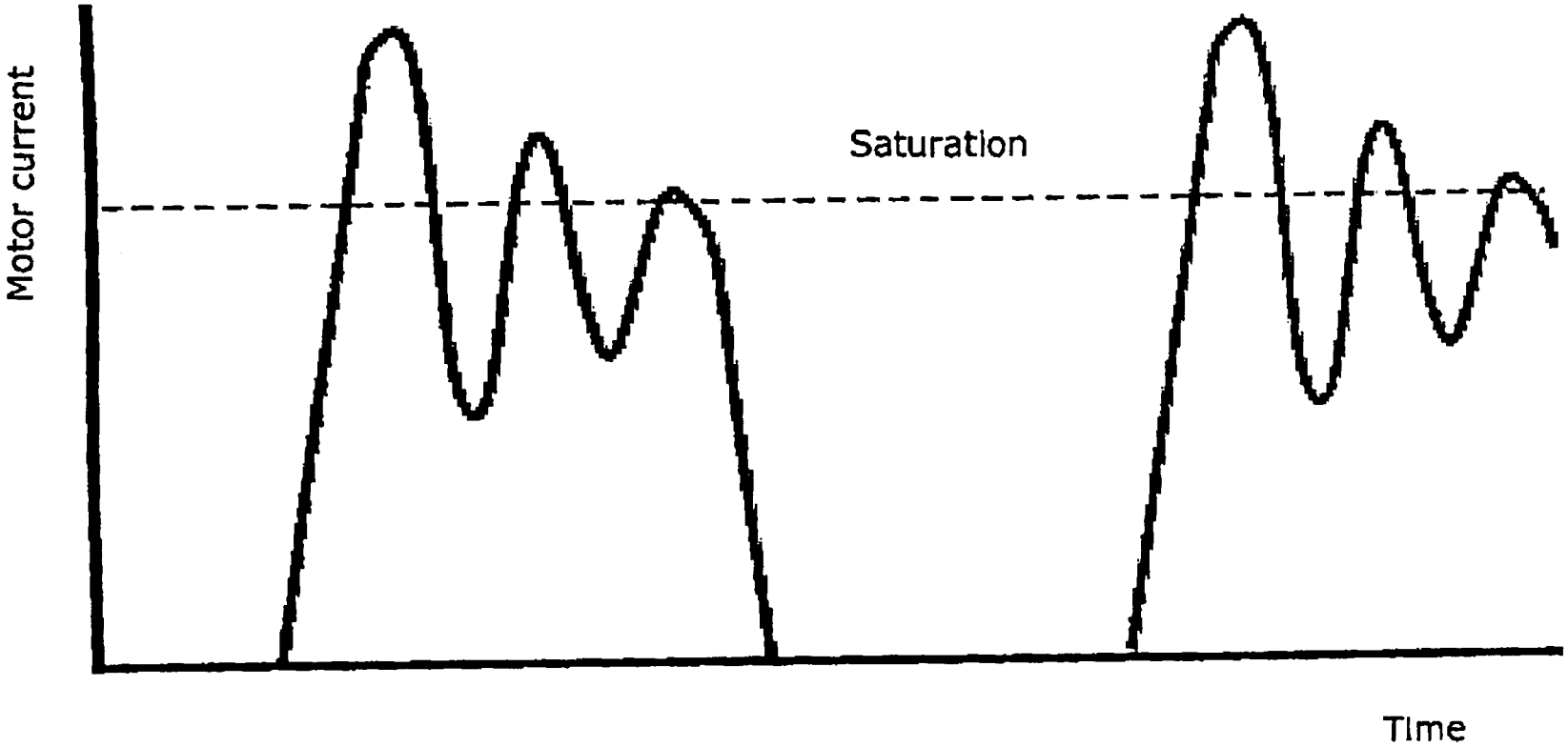
FIG. 4 shows current pulses in which ripples are produced by an elevated switching frequency and with which the electric motor of the cooling fluid pump can be powered in the heating-up phase of operation.

As power dissipation loss is produced in each switching operation, a correspondingly higher level of waste heat can be achieved when the switching frequency is increased. In this respect reference will now be made to FIG. 4 showing that the increased switching frequency means that ripples with rising and falling edges can be impressed on the respective current pulses. Those ripples result in an increased level of waste heat, in comparison with a motor current which is cyclically controlled in the manner shown in FIG. 3.

If a semiconductor switch of the control device 5 is not caused to completely conduct then it will behave at least in part like a resistor. That also gives rise to a power dissipation loss and thus an additional delivery of waste heat to the cooling fluid in the region of the control device, in the manner described in DE 100 58 374 A1 to which reference is accordingly directed for incorporation thereof.

It is further possible for the electric fan motor 6 which in this case may have suitable cooling fluid passages therein to be incorporated into the cooling fluid circuit by suitable control of a valve indicated at 11. In that case the heat exchanger or radiator 4 is by-passed and the cooling fluid flows through the motor 6. Operating the electric fan motor 6 in a lossy fashion for example in the above-described manner means that it is also possible for the cooling fluid to be additionally heated at this area in the cooling fluid circuit. The shortened cooling fluid circuit which is shortened by virtue of the heat exchanger or radiator 4 having been taken out of the circuit by corresponding actuation of the valve 11 may also include an additional electrical resistance heating means, the waste heat of which is thus delivered to the cooling fluid.

Referring still to FIG. 1, reference numeral 9 therein denotes a controlled valve by which a generator 10 such as a conventional alternator driven by the internal combustion engine 1 can be connected into the cooling fluid circuit. It is also possible for the generator 10 to be operatively disposed continuously in the cooling fluid circuit. The heat delivered by the generator 10 also serves to heat up the cooling fluid.

The invention is of considerable advantage, particularly in the case of an internal combustion engine which has a low level of consumption and which accordingly in the cold-start phase often requires a relatively long period of time in order to achieve normal operating temperature. Instead of additional preliminary heating units as are described for example in EP 0 993 546 A1, the cooling fluid is rapidly heated with the use of components which are present in any case in the vehicle and thus the internal combustion engine 1 of the vehicle can be quickly heated to its required operating temperature. It will be appreciated that in particular pollutant emission from the engine is reduced in that way.

It will be appreciated that the above-described method and arrangements have been set forth solely by way of example and illustration of the principles of the present invention and that various modifications and alterations may be made therein without thereby departing from the spirit and scope of the invention.

What is claimed is:

1. A method of regulating the operating temperature of an internal combustion engine, comprising:

circulating a cooling fluid through the internal combustion engine via a cooling pump driven by an electric motor, at least a portion of the electric motor being thermally coupled to the cooling fluid;

measuring a temperature of the cooling fluid; and controlling the electric motor to operate inefficiently if the measured temperature of the cooling fluid is below a normal operating temperature of the internal combustion engine so that waste heat is produced within the electric motor and transferred to the cooling fluid via the thermal coupling between the electric motor and the cooling fluid, the electric motor being controlled to operate inefficiently by supplying alternating forward and reverse exciter currents to the electric motor.

2. The method of claim 1, wherein the portion of the electric motor thermally coupled to the cooling fluid includes motor windings, and the waste heat produced within the electric motor is transferred to the cooling fluid as the cooling fluid flows over the windings of the electric motor.

3. The method of claim 1, further comprising controlling the electric motor to operate the cooling pump via a cyclically controlled current.

4. A method of regulating the operating temperature of an internal combustion engine, comprising:

circulating a cooling fluid through the internal combustion engine via a cooling pump driven by an electric motor having a saturation current limit, at least a portion of the electric motor being thermally coupled to the cooling fluid;

measuring a temperature of the cooling fluid; and controlling the electric motor to operate inefficiently if the measured temperature of the cooling fluid is below a normal operating temperature of the internal combustion engine so that waste heat is produced within the electric motor and transferred to the cooling fluid via the thermal coupling between the electric motor and the cooling fluid, the electric motor being controlled to operate inefficiently by supplying an amount of current to the electric motor that is at least equal to the saturation current limit of the electric motor.

5. The method of claim 4, wherein the amount of current supplied to the electric motor is greater than the saturation current limit of the electric motor.

6. A method of regulating the operating temperature of an internal combustion engine, comprising:

circulating a cooling fluid through the internal combustion engine via a cooling pump driven by an electric motor, at least a portion of the electric motor being thermally coupled to the cooling fluid;

measuring a temperature of the cooling fluid; and controlling the electric motor to operate inefficiently if the measured temperature of the cooling fluid is below a normal operating temperature of the internal combustion engine so that waste heat is produced within the electric motor and transferred to the cooling fluid via the thermal coupling between the electric motor and the cooling fluid, the electric motor being controlled to operate inefficiently by supplying pulse control signals having impressed ripples to the electric motor.

7. An apparatus for regulating the operating temperature of an internal combustion engine, comprising a cooling fluid circuit for circulating cooling fluid through the internal combustion engine;

a cooling fluid pump for transporting the cooling fluid through the cooling fluid circuit;

a temperature measuring device operable to measure a temperature of the cooling fluid;

an electric motor for driving the cooling fluid pump, at least a portion of the electric motor being thermally coupled to the cooling fluid; and a control device for controlling the electric motor in accordance with the temperature of the cooling fluid measured by the measuring device, the control device operable to control the electric motor inefficiently if the temperature of the cooling fluid measured by the measuring device is below a normal operating temperature of the internal combustion engine so that waste heat is produced within the electric motor and transferred to the cooling fluid via the thermal coupling between the electric motor and the cooling fluid, the electric motor being controllable to operate inefficiently by supplying alternating forward and reverse exciter currents to the electric motor.

8. The apparatus of claim 7, wherein at least the portion of the electric motor that is thermally coupled to the cooling fluid forms part of the cooling fluid circuit.

9. The apparatus of claim 7, further comprising electrical components thermally coupled to the cooling fluid, the electrical components being controllable to produce additional waste heat for transfer to the cooling fluid.

10. The apparatus of claim 7, wherein the control device includes semiconductor switches thermally coupled to the cooling fluid, the switches being controllable to operate inefficiently so that additional waste heat may be produced by the switches and transferred to the cooling fluid via the thermal coupling between the switches and the cooling fluid.

11. The apparatus of claim 7, wherein the electric motor and the cooling pump for an integral part of the cooling fluid circuit through which the cooling fluid flows.

* * * * *

UNITED STATES PATENT AND TRADEMARK OFFICE

CERTIFICATE OF CORRECTION

PATENT NO. : 6,951,192 B2 
DATED : October 4, 2005
INVENTOR(S) : Friedrich Atschreiter, Wolfgang Bass and Martin Kurz It is certified that error appears in the above-identified patent and that said Letters Patent is hereby corrected as shown below:

Title page,
Item [73], Assignee, should read -- Robert Seuffer GmbH & CO KG (DE); TCG Unitech AG (AT) --.

Signed and Sealed this

Twenty-seventh Day of December, 2005

JON W. DUDAS
*Director of the United States Patent and Trademark Office*